US006352055B1

(12) United States Patent
Algrain et al.

(10) Patent No.: US 6,352,055 B1
(45) Date of Patent: Mar. 5, 2002

(54) ENGINE WATER PUMP CONTROL SYSTEM

(75) Inventors: Marcelo C Algrain; Paul A Dicke, both of Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/606,519

(22) Filed: Jun. 29, 2000

Related U.S. Application Data

(60) Provisional application No. 60/167,404, filed on Nov. 24, 1999.

(51) Int. Cl.[7] ..... F01P 5/10
(52) U.S. Cl. ..... 123/41.44; 123/41.47
(58) Field of Search ..... 123/41.44–41.47

(56) References Cited

U.S. PATENT DOCUMENTS 4,977,743 A * 12/1990 Alhara et al. ..... 60/605.3
6,067,489 A * 5/2000 Letang et al. ..... 701/36
6,178,928 B1 * 1/2001 Corriveau ..... 123/41.12

* cited by examiner

*Primary Examiner*—Tony M. Argenbright
*Assistant Examiner*—Katrina B. Harris
(74) *Attorney, Agent, or Firm*—Blackwell Sanders Peper Martin, LLP

(57) ABSTRACT

A control system for controlling engine coolant flow in an engine including a first sensor positioned to sense the temperature of a first fluid in the engine and a second sensor positioned to sense the temperature of a second fluid in the engine, an electronic controller coupled with the first and second sensors to receive signals therefrom indicative of the respective temperatures of the first and second fluids, the controller being operable to determine an appropriate pump speed for each of the respective fluids based upon the temperature associated respectively therewith and thereafter outputting a signal to the engine coolant pump motor to control the speed thereof, the outputted signal being indicative of the highest pump speed dictated by the signals received from the first and second sensors.

15 Claims, 4 Drawing Sheets

ENGINE WATER PUMP CONTROL SYSTEM

This application claims the benefit of prior provisional patent application Ser. No. 60/167,404 filed Nov. 24, 1999.

TECHNICAL FIELD

This invention relates generally to the field of engine cooling apparatus for work machines and, more a particularly, to a control system to control the speed and operation of an engine coolant circulation pump.

BACKGROUND ART

Prior art engine coolant systems are typically driven directly off the engine's power train with a direct gear or belt drive arrangement wherein coolant flow is simply a function of engine speed. Since maximum exhaust temperature in an engine is typically reached near peak torque speed, the engine water pump capacity is usually designed and sized to provide the required engine coolant flow at that peak torque speed. Such an arrangement may result in excess coolant flow at higher engine speeds, which results in more heat rejection than necessary, and insufficient coolant flow at lower engine speeds. Such an arrangement also drives up the size of the cooling system, and excess power is wasted in pumping extra coolant flow at higher engine speeds because power consumption for an engine coolant pump typically increases with the cube of the pump speed. Still further, such prior art coolant systems create an unnecessary load upon the engine at start up, thereby creating an undesirable parasitic load and decreasing the cranking speed of the engine.

Another significant drawback in prior art systems is that the coolant system can cause overcooling of the engine in cold weather. In extremely cold ambient temperatures, even though engine thermostats bypass flow around the radiator, the engine still loses significant heat through the engine block and water lines wherein heat loss is a function of the coolant flow rate. At start up, during light load conditions, or at idle conditions, the coolant system can cool the engine to a temperature significantly below the desired minimum temperature or thermostat set point for the engine. As a result, engine reliability suffers when operating in an overcooled condition due to carbon build up on piston rings, valve stems and exhaust ports. Also, unburned fuel due to cold engine temperatures dilutes piston lubrication and depletes the oil base number due to the presence of fuel sulfur. Incomplete combustion of fuel also produces environmentally undesirable white smoke and slobber.

Therefore, it is desirable to control the performance of the engine coolant pump based upon the instantaneous heat dissipation requirements of the engine instead of controlling its performance as a function of engine speed. It is also desirable that the coolant system not be operational during the initial start up of the engine, and that the coolant pump operate at a minimum speed when the temperature of the engine falls below a predetermined threshold temperature to prevent overcooling. It is further desirable for the coolant pump speed to be proportionately variable when the coolant temperature is between certain predetermined minimum and maximum threshold temperatures thereby preventing insufficient or excessive cooling in the predetermined temperature threshold range.

Accordingly, the present invention is directed to overcoming one or more of the problems set forth above.

DISCLOSURE OF THE INVENTION

In one aspect of the present invention, a control system for controlling engine coolant flow in an engine is disclosed.

The control system includes a first sensor positioned to sense the temperature of a first fluid in the engine and to output a signal indicative thereof, a second sensor positioned to sense the temperature of a second fluid in the engine and to output a signal indicative thereof, an electronic controller coupled with the first and second sensors for receiving signals therefrom, the controller being operable to receive a signal from the first sensor indicative of the temperature of the first fluid and to receive a signal from the second sensor indicative of the temperature of the second fluid, the controller being further operable to determine a desired engine coolant pump speed based upon the signals received from the first and second sensors, and the controller outputting a signal to the engine coolant pump to control the speed thereof, the output signal being indicative of the highest pump speed dictated by the signals received from the first and second sensors.

In another aspect of this invention, a method for controlling the speed of an engine coolant pump associated with an engine is disclosed. The method includes the steps of sensing the temperature of a first fluid associated with the engine, sensing the temperature of a second fluid associated with the engine, determining a first pump speed based upon the first sensed temperature, determining a second pump speed based upon the second sensed temperature, comparing the first pump speed determined in step of determining a first pump speed based upon the first sensed temperature with the second pump speed determined in the step of determining a second pump speed based upon the second sensed temperature, and setting the speed of the pump to the higher of the pump speeds determined in the step of determining a first pump speed based upon the first sensed temperature and the step of determining a second pump speed based upon the second sensed temperature.

BRIEF DESCRIPTION OF THE DRAWINGS

For a better understanding of the present invention, reference may be made to the accompanying drawings in which.

BEST MODE FOR CARRYING OUT THE INVENTION

Figure 1:
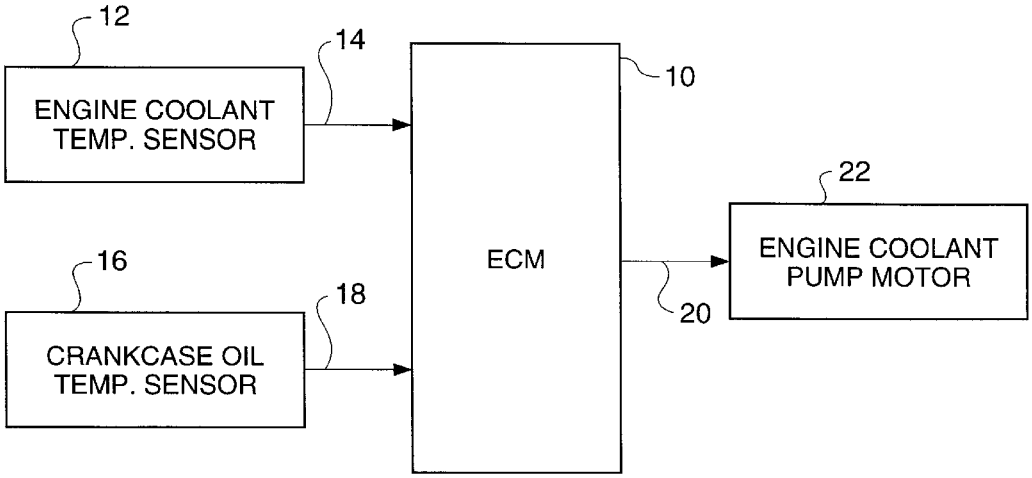
FIG. 1 is a schematic illustration of one embodiment of a control system constructed in accordance with the techniques of the present invention.

In one embodiment of the present invention as illustrated in FIG. 1, operation of an engine coolant pump is controlled by an electronic control module (ECM) 10, or some other controller or processor means capable of receiving and outputting signals as will be hereinafter explained. Electronic controllers or modules such as ECM 10 are commonly used in association with work machines and engines for controlling and accomplishing various functions and tasks including monitoring and controlling a wide variety of engine functions such as engine speed, engine load, the speed of various motors, fuel injection and so forth. Controllers and electronic modules, such as ECM 10, are typically utilized for delivering current control signals to devices such as control valves, pumps, actuators, motors, and a wide variety of various other mechanical components for controlling the operation of the work machine. In this regard, ECM 10 will typically include processing means such as a microcontroller or microprocessor, associated electronic circuitry such as input/output circuitry, analog circuits or programmed logic arrays, and associated memory.

As illustrated in FIG. 1, ECM 10 is preferably coupled to an engine coolant temperature sensor 12 positioned and located so as to sense the temperature of the engine coolant exiting the engine. Sensor 12 preferably continuously monitors the temperature of the engine coolant and outputs an appropriate signal 14 to ECM 10 indicative of such temperature. Similarly, as best illustrated in FIG. 1, ECM 10 is also preferably coupled to a crankcase oil temperature sensor 16 positioned and located so as to sense the temperature of the crankcase oil in the engine. Sensor 16 also preferably continuously monitors the temperature of the crankcase oil and outputs an appropriate signal 18 to ECM 10 indicative of such temperature.

Figure 2:
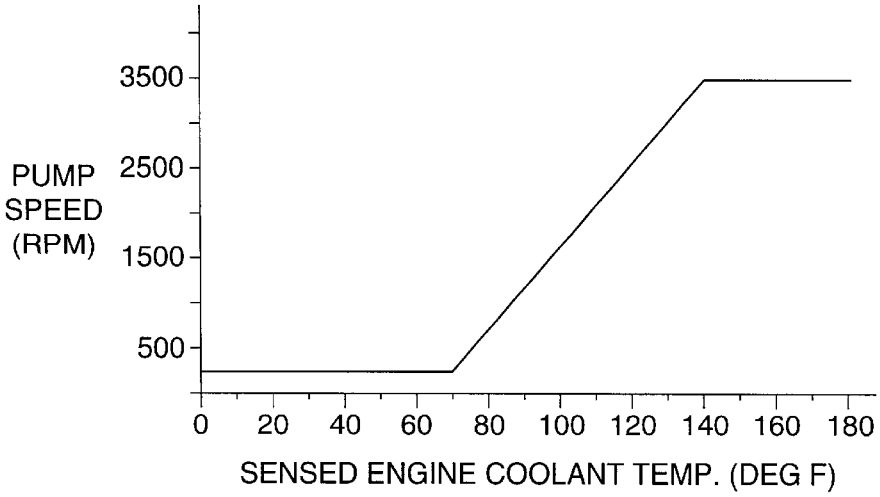
FIG. 2 is a graphical illustration showing the relationship between pump speed and engine coolant temperature in one embodiment of the present invention.

In response to signal 14, ECM 10 determines an engine coolant pump speed (EC pump speed) corresponding to the temperature sensed by engine coolant temperature sensor 12. In one embodiment of the present invention, EC pump speed is determined in accordance with the pump speed v. engine coolant temperature graph illustrated in FIG. 2. The graph of FIG. 2 represents one embodiment of a particular relationship between pump speed and the sensed engine coolant temperature. For example, if the temperature sensed by sensor 12 is at or below a minimum threshold temperature such as at or below about 70° F. (21.1° C.) as illustrated in FIG. 2, the EC pump speed is a minimum threshold pump speed of about 200 rpm. If the sensed temperature is at or above a maximum threshold temperature of about 140° F. (60.0° C.) as indicated in FIG. 2, the EC pump speed is a maximum threshold pump speed of about 3400 rpm. If the temperature of the engine coolant sensed by sensor 12 is between the minimum threshold temperature and the maximum threshold temperature, then the EC pump speed is determined as indicated by the graph in FIG. 2 based upon the straight line relationship between the minimum and maximum engine coolant threshold temperature. In this situation, the EC pump speed will be a proportional speed between about 200 rpm and about 3400 rpm based upon the straight line relationship illustrated in FIG. 2. This procedure may be implemented in one of various ways known in the art, such as storing the relationship between engine coolant temperature and EC pump speed into the memory associated with ECM 10 in the form of the graph illustrated in FIG. 2, in the form of a look-up table, or in the form of one or more equations designed to yield pump speed. Other means for determining pump speed based upon a sensed engine coolant temperature are likewise possible.

Figure 3:
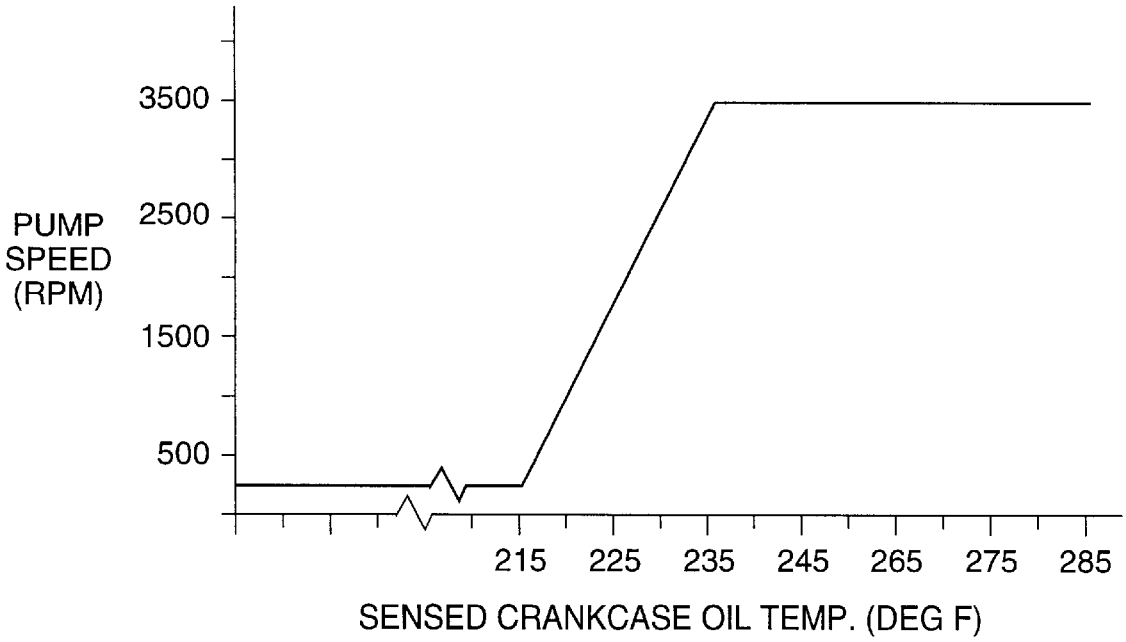
FIG. 3 is a graphical illustration showing the relationship between pump speed and crankcase oil temperature in one embodiment of the present invention.

Similarly, in response to signal 18, ECM 10 determines a crankcase oil pump speed (CK pump speed) corresponding to the temperature sensed by crankcase oil temperature sensor 16. In one embodiment of the present invention, CK pump speed is determined in accordance with the pump speed v. crankcase oil temperature graph illustrated in FIG. 3. Here again, the graph of FIG. 3 is representative of one embodiment of a particular relationship between pump speed and the sensed crankcase oil temperature. For example, if the temperature sensed by sensor 16 is at or below a minimum threshold temperature such as at or below about 215° F. (101.7° C.) as illustrated in FIG. 3, the CK pump speed is a minimum threshold pump speed of about 200 rpm. If the sensed temperature is at or above the maximum threshold temperature of about 235° F. (112.8° C.) as indicated in FIG. 3, the CK pump speed is a maximum threshold pump speed of about 3400 rpm. If the sensed temperature of the crankcase oil sensed by sensor 16 is between the minimum threshold temperature and the maximum threshold temperature, then the CK pump speed is determined as indicated by the graph in FIG. 3 based upon the straight line relationship between the minimum and maximum crankcase oil threshold temperature. In this situation, the CK pump speed will be a proportional speed between about 200 rpm and about 3400 rpm based upon the straight line relationship illustrated in FIG. 3. This procedure may also be implemented in one of various ways known in the art such as those discussed above for determining the EC pump speed. Other means for determining pump speed based upon a sensed crankcase oil temperature are likewise possible.

Figure 4A:
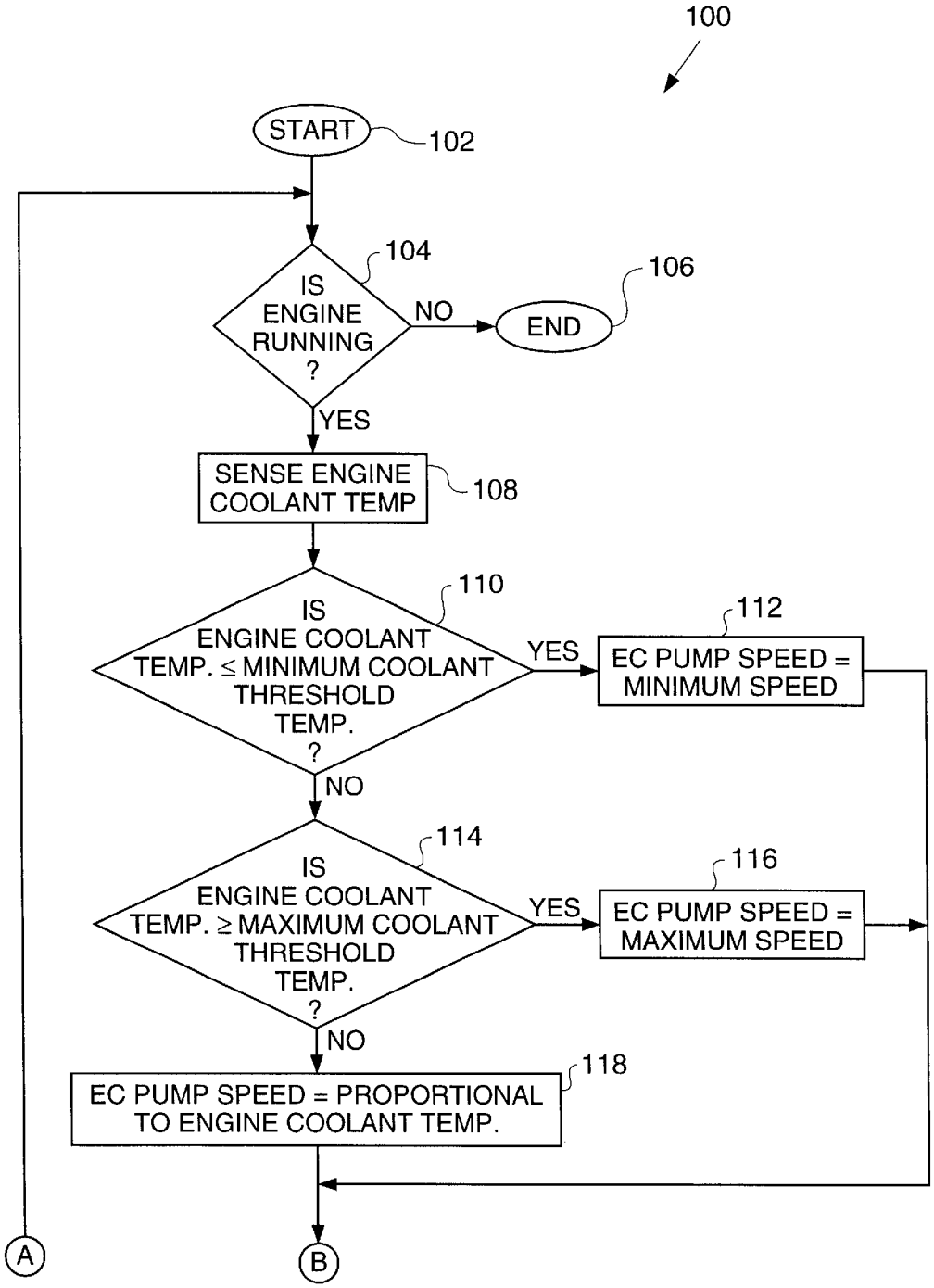
FIGS. 4A and 4B are flow charts illustrating the operating steps for determining and setting a desired pump speed in one embodiment of the present invention.
Figure 4B:
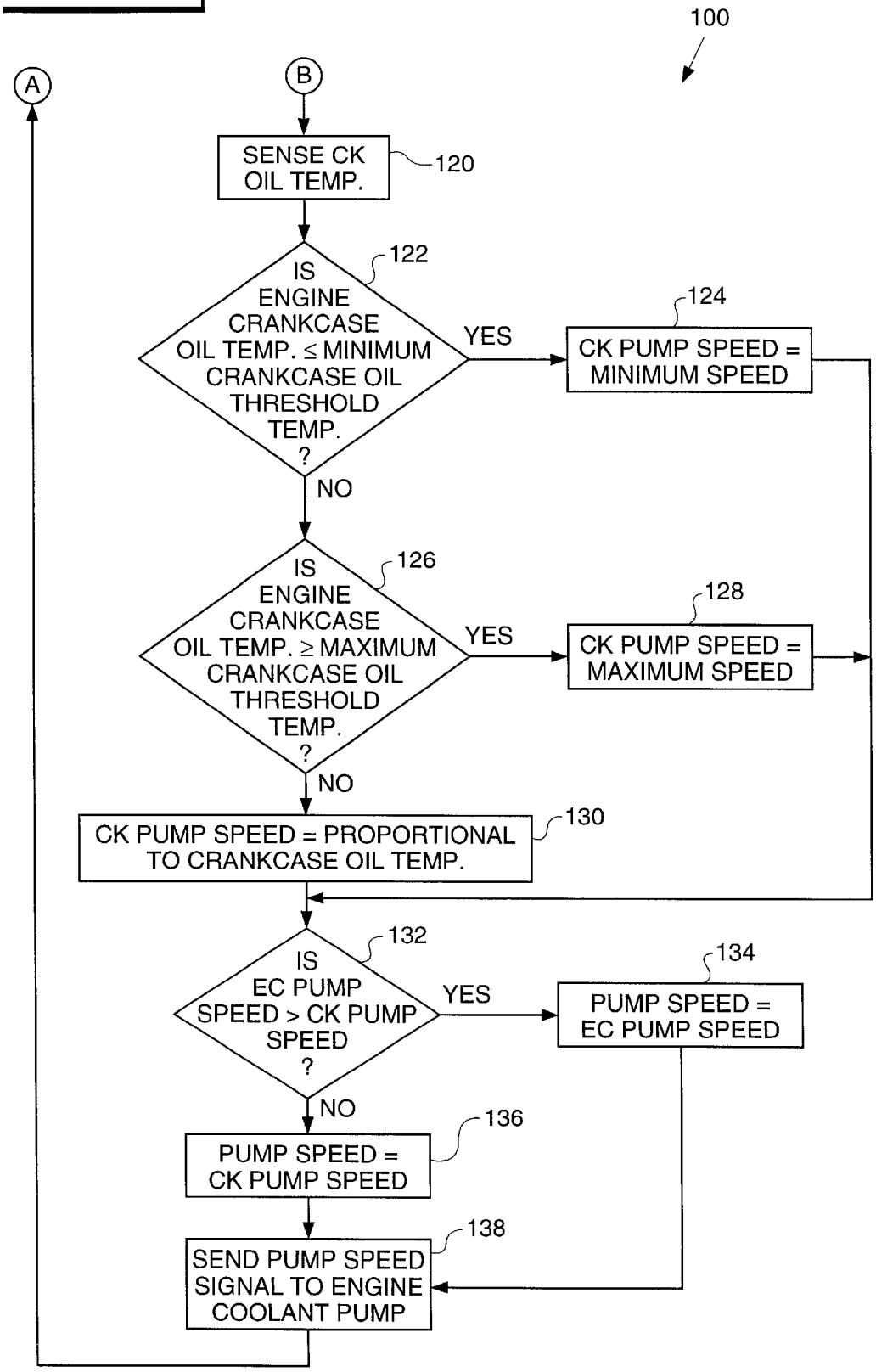

Based upon EC pump speed and CK pump speed, ECM 10 outputs a signal 20 to the engine coolant pump motor 22 to control the speed of the pump, wherein output signal 20 is indicative of the highest pump speed, that is, the higher of the EC pump speed and the CK pump speed determined by ECM 10 based upon the inputs from sensors 12 and 16. The operating steps according to one aspect of the present invention for determining and implementing the appropriate pump speed are set forth in flow chart 100 illustrated in FIGS. 4A and 4B. These steps can be incorporated into the programming of the processing means of ECM 10 by techniques well known to those skilled in the art.

The operating steps of flow chart 100 (FIGS. 4A and 4B) can be initiated after the engine is running, whereby the engine coolant pump is not a parasitic load during start up thereby increasing cranking speed and improving cold start capability. The operating steps can also be programmed to run continuously based upon some predetermined repeat interval or other criteria. Once control loop 100 is initiated at step 102, the engine speed or some other engine parameter is checked to verify whether the engine is running at step 104. If the engine is not running, then control loop 100 terminates at step 106. On the other hand, if the engine is running at step 104, then the engine coolant temperature is sensed by sensor 12 as described above at step 108. If the sensed engine coolant temperature is equal to or less than a minimum threshold temperature at step 110, the EC pump speed is determined to be the minimum speed at step 112 and ECM 10 proceeds to step 120.

If, on the other hand, the sensed engine coolant temperature is greater than the minimum threshold temperature at step 110, ECM 10 will proceed to step 114 and will determine whether the sensed temperature is greater than or equal to a maximum threshold temperature. If the sensed temperature is, in fact, greater than or equal to the maximum threshold temperature at step 114, the ECM 10 will determine the EC pump speed to be the maximum pump speed at step 116 and ECM 10 will again proceed to step 120. If, at step 114, ECM 10 determines that the sensed engine coolant temperature is not greater than or equal to the maximum threshold temperature, the ECM 10 will determine that the sensed temperature is between the minimum threshold and the maximum threshold temperatures and will thereafter further determine the EC pump speed to be a proportional speed between the minimum and the maximum threshold pump speed at step 118 such as in accordance with the relationship illustrated in the graph of FIG. 2. The ECM 10 will then proceed to step 120.

Subsequent to determining the EC pump speed, ECM 10 proceeds to step 120 and the crankcase oil temperature is sensed by sensor 16 as described above. If the sensed crankcase oil temperature is less than or equal to a minimum threshold temperature at step 122, the CK pump speed is determined to be the minimum speed at step 124, and ECM 10 will proceed to step 132. If, on the other hand, the sensed crankcase oil temperature is greater than the minimum threshold temperature at step 122, ECM 10 will proceed to step 126 and will determine whether the sensed temperature is greater than or equal to a maximum threshold temperature. If the sensed temperature is, in fact, greater than or equal to the maximum threshold temperature, the ECM 10 will determine the CK pump speed to be the maximum pump speed at step 128 and ECM 10 will again proceed to step 132. If, at step 126, the ECM 10 determines that the sensed crankcase oil temperature is not greater than or equal to the maximum threshold temperature, ECM 10 will determine that the sensed temperature is between the minimum threshold and the maximum threshold temperatures and will thereafter further determine the CK pump speed to be a proportional speed between the minimum and the maximum threshold pump speed at step 130 such as in accordance with the relationship illustrated in the graph of FIG. 3. The ECM 10 will then proceed to step 132.

At step 132, ECM 10 will determine whether the determined EC pump speed is greater than the determined CK pump speed. If the EC pump speed is greater, then the desired pump speed is determined to be the EC pump speed at step 134 and ECM 10 will proceed to output the appropriate signal 20 to the engine coolant pump motor 22 to set the speed of the pump at step 138. If, on the other hand, at step 132, the EC pump speed is less than or equal to the CK pump speed, the desired pump speed is determined to be the CK pump speed at step 136 and ECM 10 will again proceed to step 138 to output the appropriate signal 20. Signal 20 corresponding to the desired pump speed thus determined is then outputted to pump motor 22 (FIG. 1) at step 138 to control the speed of the engine coolant pump.

INDUSTRIAL APPLICABILITY

As described herein, the present control system has particular utility in all types of work machines, vehicles, and engines wherein cooling the engine is necessary. The present control system permits controlling the coolant flow in the engine in accordance with the cooling requirements of the engine instead of in accordance with the instantaneous engine speed. Fluids in the engine help determine the instantaneous cooling requirements of the engine, whereby ECM 10 can determine an appropriate speed for the engine coolant pump and generate a signal 20 to engine coolant pump motor 22 corresponding to the desired pump speed. Thus, overcooling of the engine is prevented, and power is conserved by limiting the pump's output to the engine's requirements. Furthermore, operation of the engine coolant pump is kept disengaged during initial start up of the engine thereby improving the cold-start capability, and the cranking speed of the engine.

It is also recognized and anticipated that the temperature of engine fluids other than the engine coolant fluid and the crankcase oil could be monitored and that the desired engine coolant pump speed could be determined in accordance with the teachings of the present invention based upon a relationship between any other sensed fluid temperature and the pump speed similar to the graphs illustrated in FIGS. 2 and 3. It is also recognized and anticipated that any plurality of engine fluids could be monitored by any number of sensors appropriately positioned and located to sense the temperatures of the different fluids. In this particular situation, the ECM 10 would again compare all of the different pump speeds determined based upon all of the sensed fluid temperatures and would thereafter output a signal to the coolant pump motor indicative of the highest pump speed determined for all of the plurality of fluid temperatures so sensed.

It is also recognized and anticipated that the minimum threshold pump speed corresponding to the minimum threshold temperature associated with each of the respective fluids being monitored by the present system could be different such that if all of the sensed fluid temperatures were at or below their respective minimum threshold temperatures, the ECM 10 will again select the highest minimum pump speed to be the desired pump speed outputted to the coolant pump motor. In similar fashion, the maximum pump speed associated with the maximum threshold temperature of each of the respective fluids may likewise be different and ECM 10 would again select the highest pump speed, up to the maximum speed of the pump, as the desired pump speed to be outputted to the coolant pump motor. Still further, although the relationship between pump speed and the sensed fluid temperature illustrated in FIGS. 2 and 3 are shown to be a straight line relationship between the minimum and maximum fluid threshold temperatures, it is again recognized and anticipated that this relationship could take on a wide variety of other graphic representations such as a parabolic, elliptical, hyperbolic, or any other relationship and ECM 10 can be programmed for each of these different relationships.

It is recognized that variations to the operating steps depicted in flow chart 100 could be made without departing from the spirit and scope of the present invention. In particular, steps could be added or some steps could be eliminated. All such variations are intended to be covered by the present invention.

Also, it is preferred that control loop 100 be repeated at a predetermined interval for at least as long as the engine is operating or until the ignition switch is turned off. This predetermined interval can be based upon a specific predetermined period of time, predetermined incremental changes in temperature of one or more of the various engine-fluids, or some other parameter or other criteria. In addition, at step 138, ECM 10 can be programmed to either loop back to step 104 and repeat flow chart 100, or ECM 10 could terminate at step 138 and such control loop could be thereafter repeated based upon the predetermined repeat criteria for again triggering the operating steps of flow chart 100.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A control system for controlling engine coolant flow in an engine comprising:

a first sensor positioned to sense the temperature of a first fluid in the engine and to output a signal indicative thereof;

a second sensor positioned to sense the temperature of a second fluid in the engine and to output a signal indicative thereof;

an electronic controller coupled with said first and second sensors for receiving signals therefrom, said controller being operable to receive a signal from said first sensor indicative of the temperature of said first fluid and to receive a signal from said second sensor indicative of the temperature of said second fluid;

said controller being further operable to determine a desired engine coolant pump speed based upon the signals received from said first and second sensors; and said controller outputting a signal to said engine coolant pump to control the speed thereof, said output signal being indicative of the highest pump speed dictated by the signals received from said first and second sensors.

2. The control system as set forth in claim 1, wherein said first fluid is engine coolant.

3. The control system as set forth in claim 1, wherein said second fluid is engine crankcase oil.

4. The control system as set forth in claim 1, wherein said pump is operable between a predetermined minimum threshold speed and a predetermined maximum threshold speed, said controller determining the desired pump speed for controlling coolant flow in the engine to be the minimum threshold pump speed if the temperature sensed by said first and second sensors are below a predetermined minimum temperature for said first fluid and a predetermined minimum temperature for said second fluid respectively.

5. The control system as set forth in claim 1, wherein said pump is operable between a minimum threshold speed and a maximum threshold speed, said controller determining the desired pump speed for controlling coolant flow in the engine to be the maximum threshold pump speed if the temperature sensed by said first sensor is above a predetermined maximum temperature for said first fluid or if the temperature sensed by said second sensor is above a predetermined maximum temperature for said second fluid.

6. The control system as set forth in claim 1, wherein said pump is operable between a predetermined minimum threshold speed and a predetermined maximum threshold speed, said controller determining the pump speed based upon the temperature of the first fluid to be proportionately between the minimum threshold pump speed and the maximum threshold pump speed if said first sensed temperature is between a predetermined minimum threshold temperature and a predetermined first maximum threshold temperature.

7. The control system as set forth in claim 1, wherein said pump is operable between a predetermined minimum threshold speed and a predetermined maximum threshold speed, said controller determining the pump speed based upon the temperature of the second fluid to be proportionately between the minimum threshold pump speed and the maximum threshold pump speed if said second sensed temperature is between a predetermined minimum threshold temperature and a predetermined second maximum threshold temperature.

8. The control system as set forth in claim 1, wherein said control system includes a plurality of sensors positioned at different locations for sensing the temperature of a plurality of fluids associated with the engine, said controller being operable to receive a signal from each of said plurality of sensors indicative of the temperature of the respective fluids, said controller being further operable to determine a pump speed for controlling coolant flow in the engine by determining the highest pump speed based upon the signals received from said plurality of sensors.

9. The control system as set forth in claim 1, wherein said controller determines a first pump speed as a function of the first fluid temperature and a second pump speed as a function of the second fluid temperature, said controller comparing said first pump speed to said second pump speed to generate said output signal indicative of the highest pump speed.

10. The control system as set forth in claim 1, wherein said controller determines said desired engine coolant pump speed in proportion to a sensed fluid temperature within a range of temperatures.

11. A method for controlling the speed of an engine coolant pump associated with an engine, said method comprising the steps of:

(a) sensing the temperature of a first fluid associated with the engine;

(b) sensing the temperature of a second fluid associated with the engine;

(c) determining a first pump speed based upon said first sensed temperature;

(d) determining a second pump speed based upon said second sensed temperature;

(e) comparing said first pump speed determined in step of determining a first pump speed based upon said first sensed temperature with said second pump speed determined in the step of determining a second pump speed based upon said second sensed temperature; and (f) setting the speed of said pump to the higher of the pump speeds determined in the step of determining a first pump speed based upon said first sensed temperature and the step of determining a second pump speed based upon said second sensed temperature.

12. The method as set forth in claim 11, wherein said pump is operable between a predetermined minimum threshold speed and a predetermined maximum threshold speed, the first pump speed determined in the step of determining a first pump speed based upon said first sensed temperature based upon said first sensed temperature being determined in accordance with the following criteria:

(g) if the first sensed temperature in the step of sensing the temperature of a first fluid associated with the engine is below a predetermined minimum threshold temperature, the first pump speed determined in the step of determining a first pump speed based upon said first sensed temperature will be a minimum threshold pump speed;

(h) if the first sensed temperature in the step of sensing the temperature of a first fluid associated with the engine is above a predetermined maximum threshold temperature, the first pump speed determined in the step of determining a first pump speed based upon said first sensed temperature will be a maximum threshold pump speed;

(i) if the first sensed temperature in the step of sensing the temperature of a first fluid associated with the engine is between the predetermined minimum threshold temperature and the predetermined maximum threshold temperature, the first pump speed determined in the step of determining a first pump speed based upon said first sensed temperature will be a speed proportionately between the minimum threshold pump speed and the maximum threshold pump speed.

13. The method as set forth in claim 11, wherein said pump is operable between a predetermined minimum threshold speed and a predetermined maximum threshold speed, the second pump speed determined in the step of determining a second pump speed based upon said second sensed temperature based upon said second sensed temperature being determined in accordance with the following criteria:

(g) if the second sensed temperature in the step of sensing the temperature of a second fluid associated with the engine is below a predetermined minimum threshold temperature, the second pump speed determined in the step of determining a second pump speed based upon said second sensed temperature will be a minimum threshold pump speed;

(h) if the second sensed temperature in the step of sensing the temperature of a second fluid associated with the engine is above a predetermined maximum threshold temperature, the second pump speed determined in the step of determining a second pump speed based upon said second sensed temperature will be a maximum threshold pump speed;

(i) if the second sensed temperature in the step of sensing the temperature of a second fluid associated with the engine is between the predetermined minimum threshold temperature and the predetermined maximum threshold temperature, the second pump speed determined in the step of determining a second pump speed based upon said second sensed temperature will be a speed proportionately between the minimum threshold pump speed and the maximum threshold pump speed.

14. The method as set forth in claim 11, wherein more than two fluid temperatures associated with the engine are sensed in the step of sensing the temperature of a first fluid associated with the engine and the step of sensing the temperature of a second fluid associated with the engine, and wherein more than two pump speeds are determined in the step of determining a first pump speed based upon said first sensed temperature and the step of determining a second pump speed based upon said second sensed temperature, a pump speed being determined for each sensed fluid temperature, and wherein the pump speed determined in the step of setting the speed of said pump to the higher of the pump speeds determined in the step of determining a first pump speed based upon said first sensed temperature and the step of determining a second pump speed based upon said second sensed temperature, is based upon the highest pump speed determined for the more than two fluid temperatures so sensed.

15. The method as set forth in claim 11 wherein said pump is operable between a predetermined minimum threshold speed and a predetermined maximum threshold speed in proportion to a sensed fluid temperature within a range of temperatures.

* * * * *